US012559934B2

(12) United States Patent
Hoffmann et al.

(10) Patent No.: US 12,559,934 B2
(45) Date of Patent: Feb. 24, 2026

(54) BUILDING STRUCTURE

(71) Applicant: Mageba Services & Technology AG, Buelach (CH)

(72) Inventors: Simon Hoffmann, Constance (DE); Moustafa Imam, New Westminster (CA); Pascal Savioz, Shanghai (CN)

(73) Assignee: Mageba Services & Technology AG, Buelach (CH)

( * ) Notice: Subject to any disclaimer, the term of this patent is extended or adjusted under 35 U.S.C. 154(b) by 271 days.

(21) Appl. No.: 18/230,306

(22) Filed: Aug. 4, 2023

(65) Prior Publication Data

US 2024/0026702 A1 Jan. 25, 2024

Related U.S. Application Data

(63) Continuation of application No. PCT/EP2022/052701, filed on Feb. 4, 2022.

(30) Foreign Application Priority Data

Feb. 5, 2021 (DE) ..... 10 2021 102 710.1

(51) Int. Cl.
*E04B 1/68* (2006.01)
*E01C 11/02* (2006.01)

(52) U.S. Cl.
CPC ..... *E04B 1/6803* (2013.01); *E01C 11/02* (2013.01)

(58) Field of Classification Search
CPC ..... E04H 9/021; E04B 1/6804; E04B 1/681; E04B 1/6803; E04B 1/6801;
(Continued)

(56) References Cited

U.S. PATENT DOCUMENTS 6,115,980 A 9/2000 Knak et al.
6,499,265 B2 * 12/2002 Shreiner ..... E04B 1/681 52/468
(Continued)

FOREIGN PATENT DOCUMENTS

DE 1089000 B 9/1960
DE 3826514 C1 12/1989
(Continued)

OTHER PUBLICATIONS

International Search Report issued by the European Patent Office for International Patent Application No. PCT/EP2022/052701, dated May 9, 2022.

*Primary Examiner* — Andrew J Triggs
(74) *Attorney, Agent, or Firm* — Myers Wolin, LLC

(57) ABSTRACT

A building structure with a base unit and building unit that can be moved relative to the base unit is provided with a joint cover, which bridges a compensating joint between the building unit and base unit, supported on the building unit and on the base unit. At least one of the two support structures has sliding partners, one of which is a sliding partner paired with the building or base unit in a fixed position and the other of which is a sliding partner paired with the joint cover in a fixed position. One of the sliding partners is designed as a sliding ramp in a region such that when the sliding ramp contacts the paired sliding partner, an approaching movement of the building unit towards the base unit raises the joint cover. The sliding ramp may be designed with a continuously decreasing pitch.

16 Claims, 7 Drawing Sheets

(58) Field of Classification Search
CPC .... E04B 1/6806; E04B 1/6807; E04B 1/6812; E04B 1/68; E01C 11/02; E04D 19/065; E04D 19/06
See application file for complete search history.

(56) References Cited

U.S. PATENT DOCUMENTS

| | | | | |
|---|---|---|---|---|
| 10,053,857 | B1 | 8/2018 | Gebhardt | |
| 12,146,316 | B2 * | 11/2024 | Devlin | E01C 11/08 |
| 12,359,383 | B2 * | 7/2025 | Hoffmann | E01D 19/062 |
| 2005/0241084 | A1 * | 11/2005 | Delis | E01D 19/065 14/73.5 |
| 2008/0148499 | A1 * | 6/2008 | Bradford | E01D 19/062 14/73.5 |
| 2023/0374778 | A1 * | 11/2023 | Imam | E04B 1/6804 |
| 2024/0026702 | A1 * | 1/2024 | Hoffmann | E04B 1/681 |

FOREIGN PATENT DOCUMENTS

| | | | |
|---|---|---|---|
| EP | 0356628 | B1 | 9/1991 |
| EP | 2703560 | B1 | 12/2016 |
| WO | 0198599 | A1 | 12/2001 |

* cited by examiner

BUILDING STRUCTURE

CROSS REFERENCE TO RELATED APPLICATIONS

This application is a continuation under 35 U.S.C. § 120 of International Application PCT/EP2022/052701, filed Apr. 4, 2022, which claims priority to German Application No. 10 2021 102 710.1, filed Feb. 5, 2021, the contents of each of which are incorporated by reference herein.

FIELD OF THE INVENTION

The present invention relates to a building structure comprising a basic structural unit and a building unit bearing-mounted to be movable laterally relative thereto, wherein an expansion joint having a walkable and/or drivable joint cover is present laterally relative to the building unit, between this and the basic structural unit, wherein the joint cover is braced via a first bracing structure on the building unit and via a second bracing structure on the basic structural unit, the first bracing structure comprises a pairing of two sliding partners, of which one is a bracing sliding partner associated in positionally fixed relationship with the building unit and one is a braced sliding partner associated in positionally fixed relationship with the joint cover, and/or the second bracing structure comprises a pairing of two sliding partners, of which one is a bracing sliding partner associated in positionally fixed relationship with the basic structural unit and one is a braced sliding partner associated in positionally fixed relationship with the joint cover, and at least one of the sliding partners is constructed at least in region ("lifting region") in such a way as a sliding ramp that, during sliding contact of the sliding ramp with the associated sliding partner, an approach of the building unit toward the basic structural unit in the sense of a reduction of the clear width of the expansion joint leads to lifting of the joint cover in the region of the bracing structure in question.

BACKGROUND

Especially in earthquake-prone zones, it is common practice, for protection of buildings from seismic shaking, to decouple the building from the foundation ground, by mounting it on bearings with the ability to move lateral relative to a basic structural unit (which is constructed in positionally fixed relationship with the foundation ground). For this purpose, especially bearings having damping and/or restoring action exist, for example in the form of RESTON®PENDULUM pendulum-type slide bearings or LASTO®HDRB elastomeric laminated isolators of Mageba SA, Bülach (Switzerland). In order to enable such lateral movement of the building relative to the basic structural unit, it maintains a distance laterally relative to the basic structural unit; an expansion joint is present between the building unit and the basic structural unit. This is bridged by means of a suitable walkable or drivable cover.

Various concepts, the use of which is adapted to the individual boundary conditions (width of the joint gap, load, etc.) exist for the construction of such walkable and/or drivable covers of the said expansion joints. A simple cover plate sliding at both sides on bracing structures and having hold-down and centering means can be inferred, for example, from U.S. Pat. No. 10,053,857 B1.

EP 0 356 628 B1, EP 2 703 560 B1 and DE 38 26 514 1 respectively disclose a multi-part cover. Therein, respectively two parts—movable relative to one another—of the cover in question are joined in articulated manner with the two rim profiles bounding the expansion joint. According to EP 0 356 628 B1, the two parts linked pivotally to the rim profiles (for the purpose of adaptation to a changing joint width) are displaceable relative to one another, in that they engage telescopically in one another by means of a tongue and groove arrangement. According to EP 2 703 560 B1, a curved middle plate extends between the two parts linked pivotally to the rim profiles, and (for the purpose of adaptation to a changing joint width) engages with its two mutually opposite rims displaceably in one groove each of the associated part of the cover linked pivotally to the rim profile in question. And according to DE 38 26 514 C1, the two parts linked pivotally (for the purpose of adaptation to a changing joint width) to the rim profiles and respectively provided with a cover strip are in turn joined to one another in articulated manner with a swivel axis parallel to their pivot axes and elevated relative thereto.

WO 01/98599 A1 discloses, for expansion joints, joint covers that can be lifted (or can be "extricated" from their operating position) on both sides via two sliding ramps or on one side via one sliding ramp. This joint cover is bounded laterally by two or one side face(s) cooperating with the associated sliding ramp and correspondingly inclined relative thereto. Therein the (unilateral or bilateral) extrication of the joint cover takes place not just as soon as an only slight approach of the two structures bounding the expansion joint, but to the contrary only when a minimum extent is exceeded; this is so because, if the two structures approach from their design configuration, the joint cover slides at first, without being lifted, on its horizontal bracing until its inclined side face(s) come(s) up against the (respectively associated) sliding ramp.

SUMMARY

The present disclosure has set itself an object of providing a generic building structure that is improved compared with the prior art in terms of its functional principle and operating properties. In particular, this involves improved operating properties and a reduced risk of failure for relatively large and heavy joint covers and/or for such that can withstand relatively large loads, namely in case of particularly violent and/or long-lasting or repeated seismic events.

This object is achieved in a surprisingly simple way in that—in a generic building structure—the sliding ramp is constructed in such a way over at least part of its extent with a steadily decreasing slope that, upon sliding contact of the associated sliding partner with this portion ("degression curvature portion") of the sliding ramp during approach of the building unit toward the basic structural unit, the ratio of the vertical velocity of lifting of the joint cover in the region of the bracing structure in question to the horizontal relative velocity between building unit and basic structural unit decreases steadily. The steady decrease of the slope of the sliding ramp is therefore related to the direction of the displacement ("migration"), occurring during the reduction of the clear width of the expansion joint and accordingly during the lifting of the joint cover, of the contact point, on the sliding ramp, between sliding partner and said sliding ramp. In the region of the (convexly curved) degression curvature portion, the sliding ramp—taking into consideration the geometry of the sliding partner sliding thereon—is accordingly constructed such that that a lateral movement, acquired with constant horizontal velocity, of the building unit relative to the basic structural unit (accompanied by lateral approach of the building unit to the basic structural unit) leads to lifting, with steadily decreasing vertical velocity, of the joint cover in the region of the bracing structure in question. A core of the present disclosure is accordingly the construction of the sliding ramp—at least in portions—as non-planar but to the contrary as curved or arched in such a way that, during sliding of the sliding partner over this portion of the sliding ramp—during approach of the building unit and basic structural unit toward one another, i.e. during a reduction of the clear width of the expansion joint—a steadily changing ratio of the horizontal velocity between building unit and basic structural unit to the lifting velocity of the joint cover takes place at the bracing structure in question. This ratio increases with progressive lateral approach of the building unit and basic structural unit toward one another, in that the lifting velocity decreases steadily during the acquired approach movement with constant velocity. The present disclosure therefore departs expressly from the maxim, followed heretofore in the prior art, of linearity between the advancing lifting of the joint cover (where such lifting occurs) and the displacement path of the building unit relative to the basic structural unit.

Particularly in view of the fact that, during seismic events of the type primarily of interest here, the building on pendulum-type bearings typically excited to vibrations (damped by bearing technology), and so the expansion joint bridged by the joint cover constantly becomes repeatedly smaller and larger, the advantages achievable by implementations of the present invention are immense. First and foremost in this respect, it is to be pointed out that the kinetics are significantly improved compared with the prior art because the acceleration of the joint cover downward (when lifted in a first phase of the vibrating compensating movement) is distributed and controlled in defined manner over a defined displacement path of the building unit relative to the basic structural unit, when this—due to re-enlargement of the initially reduced clear width of the expansion joint—returns to its design or regular operating position. By the fact that, in implementations of the present invention, accelerated sliding of the joint cover back to its original (starting position) takes place in the degression curvature portion in a manner defined according to the ramp geometry, and that the joint cover does not instead fall back uncontrollably, sudden loads or stresses are avoided or at least greatly reduced. The situation is analogous for the conditions during lifting of the joint cover. This is so because, due to the inventive configuration of the sliding ramp in such a way that it has a degression curvature portion, a defined deceleration—toward the end of extrication—of the lifting movement of the joint cover can be achieved. An overreaction such as especially jumping movement of the joint cover—during a strong seismic event with particularly rapid approach of the building unit toward the basic structural unit when it is moved in correspondingly highly dynamic manner from its design configuration—with a subsequent hard, violent impact can be avoided. Accordingly, compared with the prior art, the risk of damage to the sliding bracing (or to the two sliding bracings) of the joint cover is decisively reduced; this (these) remain(s) functional, so that even multiple overshooting of the sliding ramp(s) by the sliding partners in both directions is possible while maintaining the defined properties.

The decisive aspects explained in the foregoing for the high operating safety of the earthquake safeguard develop their advantageous effect to a particularly pronounced degree when the building, as explained hereinabove, is by design excited to vibrations relative to the foundation ground due to a seismic event, whereby the joint cover is constantly extricated repeatedly in rapid sequence from the expansion joint and returned again to its regular, lowered position.

By the fact that sudden loads acting on the joint cover are prevented or at least decisively reduced, maximum stress occurring during a defined seismic event and acting on the joint cover can be effectively reduced. Because of its substantially reduced mechanical stress in the earthquake situation—compared with the prior art—the joint cover can therefore be less massively constructed than known joint covers while still having the same resistance to seismic stress; the accordingly more lightweight construction of the joint cover in turn acts in the sense of a reduction of the acceleration forces necessary for the lifting movement and accordingly of the load or mechanical stress of the joint cover. It is also to be emphasized that, in implementations of the present invention, there can be, due to the illustrated favorable properties, bridged with a single, continuous joint cover even expansion joints of such large clear width, for which this was not possible according to the prior art. The following explanation of the invention shows diverse further advantages, especially in case of its implementations according to particularly preferred configurations presented hereinafter.

Ideally, the curvature of the sliding ramp changes steadily in its degression curvature portion. Specifically, in a particularly preferred configuration of the invention, the geometry of the sliding ramp in the region of the degression curvature portion may then assume the function of a parabola or of a clothoid. Hereby particularly "soft" load profiles are achieved. However, significant advantages compared with the prior art can be achieved by suitable geometries having constant curvature, i.e. with curves that follow the portion of a circular cylinder.

In a preferred configuration of the invention, not only does the degression curvature portion of the sliding ramp have a convexly curved geometry, but also the sliding partner sliding over it (and constructed in the form of a "cam", for example) is typically provided with a convexly curved geometry, wherein the contact point (or the contact line) also "migrates" on the surface of the sliding partner during the sliding movement of the sliding partner in question on the degression curvature portion of the sliding ramp. Thus the geometry of the sliding partner is non-negligible as regards the kinematic conditions. It has been possible to ascertain that—in designing the earthquake safeguard for a maximum horizontal relative velocity of displacement of the building relative to the foundation ground between 250 mm/s and 650 mm/s, which encompasses the greatly predominant range of application situations of the present invention—an "equivalent radius" of at least 25 mm, preferably of at least 40 mm is favorable. What is to be understood by "equivalent radius" in this context is the sum of the smallest radii of curvature of the degression curvature portion and of sliding partners cooperating slidingly therewith, wherein both radii of curvature are expressed as magnitudes, i.e. with positive signs. In the interests of a compact construction of the earthquake safeguard, the equivalent radius—in the design situation mentioned above—should not be more than 90 mm, preferably not more than 70 mm.

If a higher maximum horizontal relative velocity of displacement of the building relative to the foundation ground is to be assumed on the basis of the seismic activities to be expected locally, the advantageous range for the equivalent radius is shifted upward, e.g. toward 80 mm to 180 mm for a maximum horizontal relative velocity of displacement of the building of up to 1000 mm/s and toward 120 mm to 240 mm for a maximum horizontal relative displacement of the building of up to 1500 mm/s.

According to a particularly preferred further embodiment of the invention, the at least one bracing structure having two sliding partners sliding over one another is further provided with a sliding ramp constructed in such a way over at least part of its extent with a steadily increasing slope that, upon sliding contact of the associated sliding partner with this portion ("progression curvature portion") of the sliding ramp during approach of the building unit toward the basic structural unit, the ratio of the vertical velocity of lifting of the joint cover in the region of the bracing structure in question to the horizontal relative velocity between building unit and basic structural unit increases steadily. In the region of the progression curvature portion, the sliding ramp—taking into consideration the geometry of the sliding partner sliding thereon—is accordingly constructed such that a lateral movement, acquired with constant horizontal velocity, of the building unit relative to the basic structural unit (accompanied by lateral approach of the building unit toward the basic structural unit) leads to lifting, with steadily increasing vertical velocity, of the joint cover in the region of the bracing structure in question. In contrast to the degression curvature portion, what is achieved by the construction of the sliding ramp, which is concavely curved or arched here, i.e. on the progression curvature portion of the sliding ramp, is that, during sliding of the sliding partner over this portion of the sliding ramp—during approach of the building unit and basic structural unit toward one another, i.e. during a reduction of the clear width of the expansion joint—a steadily decreasing ratio of the horizontal velocity between building unit and basic structural unit to the lifting velocity of the joint cover takes place at the bracing structure in question, in that, during the acquired approach movement with constant velocity, the lifting velocity steadily increases.

As regards the lifting of the joint cover, the progression curvature portion causes an effective shift in time of the acceleration forces, so that they do not act suddenly. In turn, the maximum load occurring for a defined seismic event and acting on the joint cover can be effectively reduced. This additionally reduces the risk of damage to the joint cover in the earthquake situation and of failure of the earthquake safeguard caused thereby.

The progression curvature portion may be constructed on the same sliding ramp as the degression curvature portion, so that degression curvature portion and progression curvature portion are part of the same sliding ramp. However, this is not obligatory. To the contrary, as especially the explanation of a corresponding exemplary embodiment shows, the two regions may also be constructed if necessary on two different sliding ramps. If—in a preferred further development—a progression curvature portion is provided, this is so disposed that, during the reduction of the clear width of the expansion joint, bracing of the joint cover via the progression curvature portion precedes bracing of the joint cover via the degression curvature portion. When both portions are constructed on the same sliding ramp, the degression curvature portion may adjoin the progression curvature portion of the sliding ramp (directly or else indirectly via a planar transition portion of the sliding ramp) in that direction in which the contact point is displaced during a reduction of the clear width of the expansion joint. Ideally, the lifting of the joint cover will be initiated via the sliding contact on the progression curvature portion and will taper off via the sliding contact on the degression curvature portion.

This preferred further development explained in the foregoing also proves in turn to be quite particularly advantageous in view of the circumstance that, as has already been mentioned hereinabove, a building on pendulum-type bearings is typically excited to vibrations (damped by pendulum technology), and so the expansion joint bridged by the joint cover constantly becomes repeatedly smaller and larger during seismic events of the type of primary interest here, wherein the joint cover is accordingly lifted constantly in alternating succession (during reduction of the clear width of the joint gap) above the ramp arrangement and (during increase of the clear width of the joint gap) is returned once again to the starting position. In the process, the degression curvature portion is able to ensure controlled "soft" acceleration of the joint cover at the beginning of its downward movement, while in contrast the progression curvature portion—toward the end of the downward movement of the joint cover—is able to ensure its controlled "soft" deceleration.

Another preferred further embodiment of the inventive building structure is characterized in that the progression curvature portion of the sliding ramp has a sliding face curved with steadily increasing curvature. In particular, this curvature of the curved sliding face in the region of the progression curvature portion of the sliding ramp may have the form of a clothoid portion. In this way, the advantages mentioned hereinabove can be achieved in a particularly pronounced way, since the forces acting to extricate the joint cover during a seismic event are in this case distributed over a particularly homogeneous time profile with the consequence of particularly "gentle" stress of the joint cover.

However, this further development already proves to be very advantageous even in other and possibly less complexly constructed geometries of the progression curvature portion of the sliding ramp. Thus the progression curvature portion of the sliding ramp may also have in particular a sliding face curved in the manner of a circular cylindrical portion (concave). In this connection, however, it is important to point out the cooperation of the geometry of the progression curvature portion of the sliding ramp with the geometry of the sliding partner sliding on the sliding ramp (possibly in the form of a so-called "cam"). This is so because the steady change of the ratio between the vertical and horizontal velocity that is decisive according to the present disclosure, i.e. the lifting of one region of the joint cover with steadily increasing vertical velocity (during approach of the building unit to the basic structural unit with acquired constant horizontal velocity) does not take place when the sliding partner has a counter sliding face that is curved (convexly) with the same radius of curvature as the progression curvature portion of the sliding ramp and therefore corresponds thereto. In this case, a sudden onset of the lifting movement of the joint cover would actually occur in turn. In this respect, it is essential that a possible (convex) camber of the counter sliding face of the sliding partner cooperating with the progression curvature portion of the sliding ramp have a significantly smaller radius of curvature than a sliding face of the progression curvature portion of the sliding ramp curved (concavely) in the form of a circular arc portion. "Significantly smaller" in this sense is to be regarded as a radius of curvature of the sliding partner that is at most 35%, preferably at most 25% of the radius of curvature of the progression curvature portion of the sliding ramp. Incidentally, the foregoing viewpoints are correspondingly applicable for embodiments of the invention in which the progression curvature portion of the sliding ramp has a sliding face that is not curved (concavely) in the form of a circular arc portion but instead follows the curve, for example, of a clothoid. Here also, constructing the sliding partner sliding (in the region of the progression curvature portion) on the sliding ramp with a geometry corresponding to the geometry of the sliding ramp is to be avoided; and it is essential that a possible (convex) camber of the counter sliding face of the sliding partner cooperating with the progression curvature portion of the sliding ramp have—in the above sense—a significantly smaller radius of curvature than the (concavely curved) sliding face of the progression curvature portion of the sliding ramp.

According to another preferred further embodiment of the invention, at least one of the two sliding partners in the bracing structure, which has the sliding partner constructed regionally as the sliding ramp, is further constructed in one region (in a so-called "displacement region") in such a way as a horizontal sliding face that, during sliding contact of the associated sliding partner having the horizontal sliding face, a laterally directed movement of the building unit relative to the basic structural unit in the region of the bracing structure in question has no effect on the position of the joint cover in vertical direction. In particular, such a horizontal sliding face can be so disposed and constructed that bracing of the joint cover takes place via it when, relative to the design configuration, the clear width of the expansion joint increases (especially due to a seismic event). However, such a horizontal sliding face is also advantageously realized in such a way that bracing of the joint cover in a first part of the compensating movement takes place via it when, relative to the design configuration, the clear width of the expansion joint is reduced (especially due to a seismic event); the described lifting or extrication of the joint cover begins in this case only after a threshold value for the approach of building unit and basic structural unit is exceeded. In this way, it can be ensured that the joint cover—during only small displacement movements of the building unit relative to the basic structural unit—retains its vertical position or orientation unchanged and remains walkable or drivable without any restriction.

In a quite particularly preferred further development, the horizontal sliding face has a different surface texture than the sliding ramp, at least in a service region, especially by providing the horizontal sliding face in the service region with a lower hardness and/or a smaller ratio of static friction to sliding friction and/or a lower coefficient of friction than the sliding ramp. In this way, the operating behavior can be favorably influenced in several respects. Via the service region, bracing of the joint cover takes place in the design case with consideration of non-seismic, i.e. especially thermal compensating movements (expansion/contraction). Here, i.e. in this "service path", low static friction is very advantageous, in order to minimize stick-slip effects. A friction level that is relatively low overall is also advantageous in the service region. Nevertheless, higher friction—compared with the conditions during the "service path"—during passage of the sliding partner over the ramp (due to a seismic event), i.e. during lifting/extrication of the joint cover (and also during sliding back into the starting level) may contribute to specific damping effects and reduce the danger of an "overreaction".

In the further embodiment of the invention mentioned in the forgoing, it is particularly preferable when both the sliding ramp provided with the progression curvature portion and the horizontal sliding face are part of the same sliding partner of the bracing structure in question. In particular, it is possible in this sense, in a preferred configuration, for both the sliding ramp (provided with the progression curvature portion) and the horizontal sliding face to be components of the bracing sliding partner of the first bracing structure or of the second bracing structure. In typical application situations, it is then advantageous in the structural respect as well as from viewpoints of favorable operating properties when the sliding ramp and the horizontal sliding face—ideally without any discontinuity with respect to slope, i.e. without any "kink"—merge directly into one another, wherein, in the course of approach, starting from the design configuration, of the building unit toward the basic structural unit (with reduction of the clear width of the expansion joint), continuous bracing of the joint cover on the bracing structure in question takes place first in the displacement region and then in the lifting region.

Subject to special structural prerequisites, however, and in a departure from the configuration mentioned in the foregoing, it may prove advantageous when, in the course of approach of the building unit toward the basic structural unit (with reduction of the clear width of the expansion joint) on the bracing structure in question, (sudden) transfer of the bracing of the joint cover on the bracing structure in question takes place from the displacement region to the lifting region. For this purpose, a horizontal sliding face and a sliding ramp may be constructed in a manner spatially separated from one another, for example on the bracing sliding partner in question, wherein the associated braced sliding partner has a first region cooperating with the horizontal sliding face and, spatially separated therefrom, a second region cooperating with the sliding ramp. It is all the more likely that a sudden transfer of the bracing of the joint cover on the bracing structure in question can take place from the displacement region to the lifting region when, on the bracing structure in question, the horizontal sliding face is provided on the one sliding partner (e.g. the bracing sliding partner) and the sliding ramp receiving the bracing is provided on the other sliding partner (e.g. the braced sliding partner).

If the sliding ramp—spatially distanced from the horizontal sliding face—is constructed in the advantageous manner already mentioned hereinabove on the bracing sliding partner of the bracing structure in question, it may be particularly advantageous when the sliding partner cooperating with the sliding ramp has the form of a wedge, wherein, in the course of approach of the building unit toward the basic structural unit (with reduction of the clear width of the expansion joint), a sudden transfer of the bracing of the joint cover on the bracing structure in question takes place from the sliding ramp to a further bracing element of the sliding partner provided with the sliding ramp. The said transfer takes place when the sliding path provided by the sliding ramp is exhausted. By the fact that transfer of the wedge-shaped sliding partner, which cooperates with the sliding ramp and preferably is constructed in crown-like, convexly curved manner, to a further bracing element takes place at the end of the sliding path provided by the sliding ramp, it is possible in a particularly simple way to influence the individual, specific sliding behavior within the various phases of lifting/extrication of the joint cover from its normal operating position.

Embodiments of the present disclosure can already be realized with joint covers that can be lifted or extricated only on one side, in which the other bracing structure is constructed in the form of a fixed bearing, in the sense that, at the other rim region, for example, the joint cover is linked pivotally—at least to a certain small extent—to the bracing part of the building structure. Nevertheless, configurations with joint covers that can be lifted or extricated on both sides are particularly preferred, where both the first bracing structure and the second bracing structure therefore respectively comprise a pairing of two sliding partners having respectively at least one sliding ramp. Advantageously, a centering device, which ensures the central position of the joint cover relative to the two parts of the building structure bounding the expansion joint, acts in this case on the joint cover, regardless of their actual distance from one another. In particular, this centering device can comprise a hold-down means acting on the joint cover and counteracting jumping movement of the joint cover. This also acts in the sense of favorable operating properties.

All aspects mentioned in the foregoing for an inventive building structure having an expansion joint disposed between a basic structural unit and a building unit (including the further developments and preferred configurations specified or evident in this regard) are correspondingly valid for a walkable or drivable joint cover that—disposed between two bearing-mounted building units that can be moved laterally relative to one another—bridges an expansion joint provided between the two building units in question. In this respect, the invention is also aimed at a building structure, comprising two building units bearing-mounted to be movable laterally relative to one another, wherein an expansion joint having a walkable and/or drivable joint cover is present between the building units, wherein the joint cover is braced via a first bracing structure on the first building unit and via a second bracing structure on the second building unit, the first bracing structure comprises a pairing of two sliding partners, of which one is a bracing sliding partner associated in positionally fixed relationship with the first building unit and one is a braced sliding partner associated in positionally fixed relationship with the joint cover, and/or the second bracing structure comprises a pairing of two sliding partners, of which one is a bracing sliding partner associated in positionally fixed relationship with the second building unit and one is a braced sliding partner associated in positionally fixed relationship with the joint cover, and at least one of the sliding partners is constructed at least in one region ("lifting region") in such a way as a sliding ramp that, during sliding contact of the sliding ramp with the associated sliding partner, approach of the two building units relative to one another in the sense of a reduction of the clear width of the expansion joint leads to lifting of the joint cover in the region of the bracing structure in question, wherein the sliding ramp is constructed in such a way over at least part of its extent with a steadily decreasing slope that, during sliding contact of the associated sliding partner with this portion ("degression curvature portion") of the sliding ramp during approach of the building units relative to one another, the ratio of the vertical velocity of lifting of the joint cover in the region of the bracing structure in question to the horizontal relative velocity between the two building units steadily decreases. Thus, in the region of the degression curvature portion, the sliding ramp—taking into consideration the geometry of the sliding partner sliding thereon—is constructed here such that a lateral movement, acquired with constant horizontal velocity, of the two building units relative to one another (with reduction of the clear width of the expansion joint) leads to lifting, with steadily decreasing vertical velocity, of the joint cover in the region of the bracing structure in question. In view of the foregoing explanations about the first concept, explanations of this second concept of the invention are unnecessary.

BRIEF DESCRIPTION OF THE DRAWING

The present invention will be explained in more detail hereinafter on the basis of two exemplary embodiments shown in the drawing, wherein.

DETAILED DESCRIPTION OF THE PREFERRED EMBODIMENTS

Figure 1:
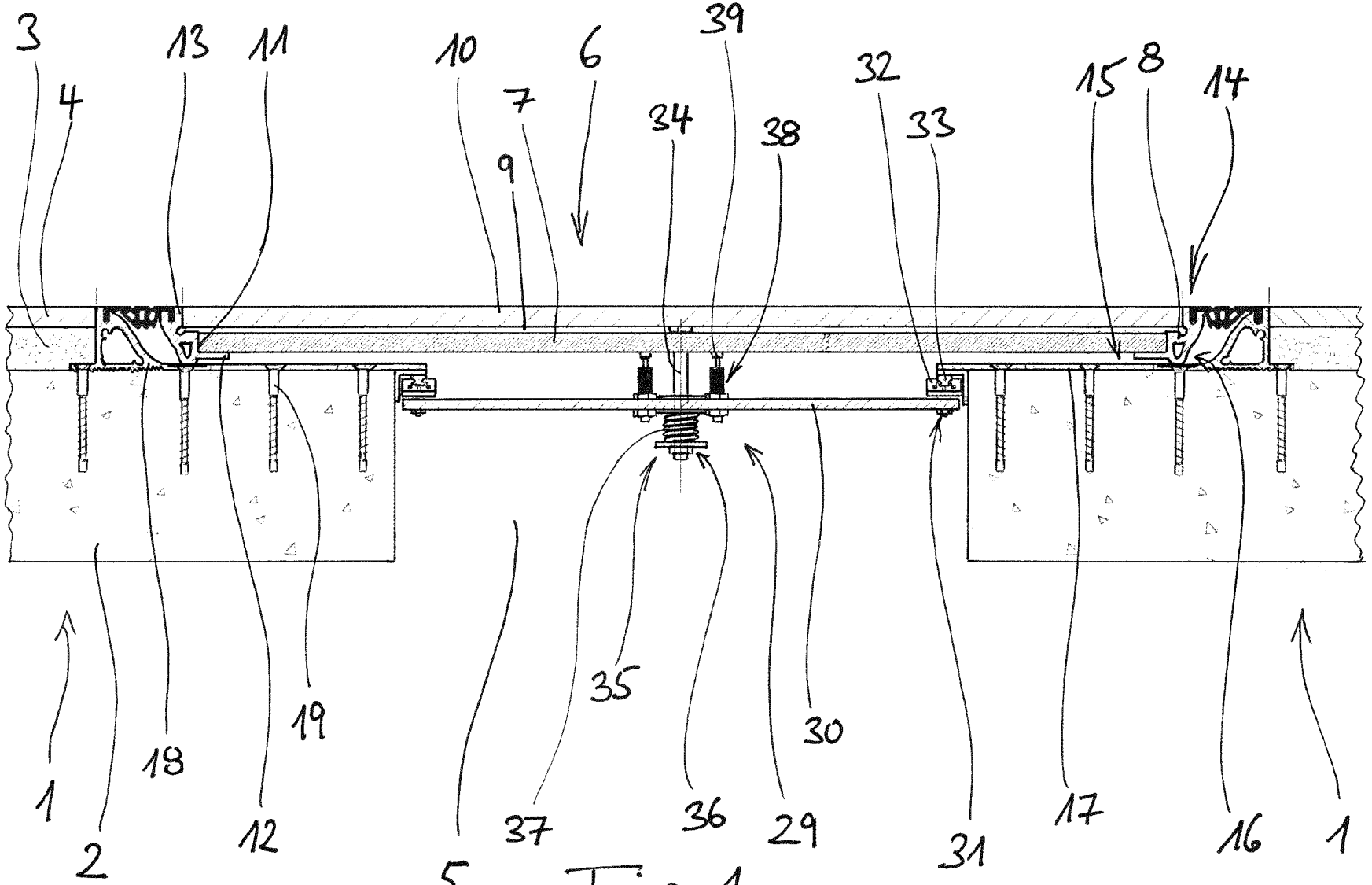
FIG. 1 shows, in a general view, a vertical section through a first inventive building structure.
Figure 1A:
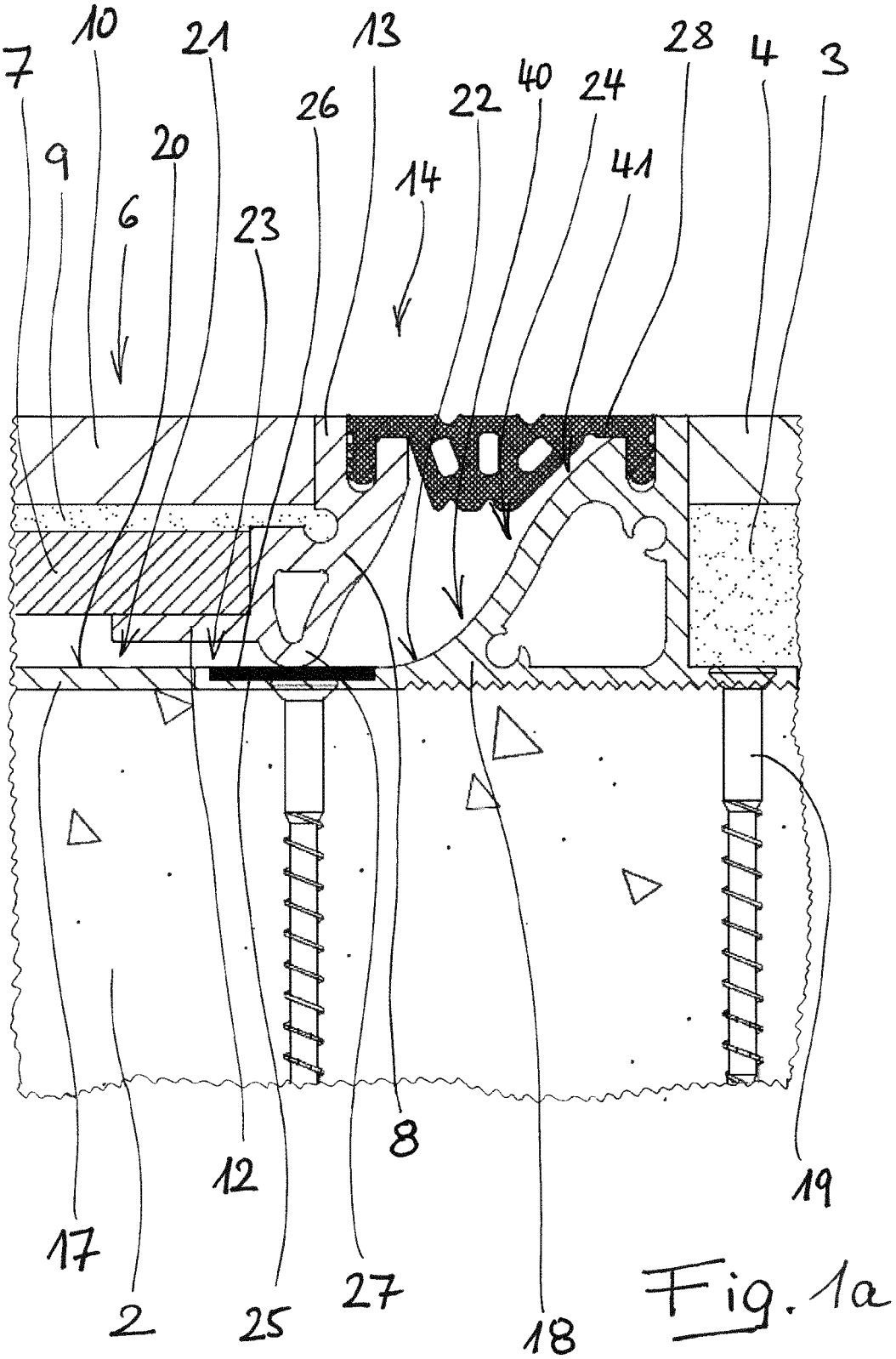
FIG. 1*a* shows a detail of the building structure according to FIG. 1.
Figure 2:
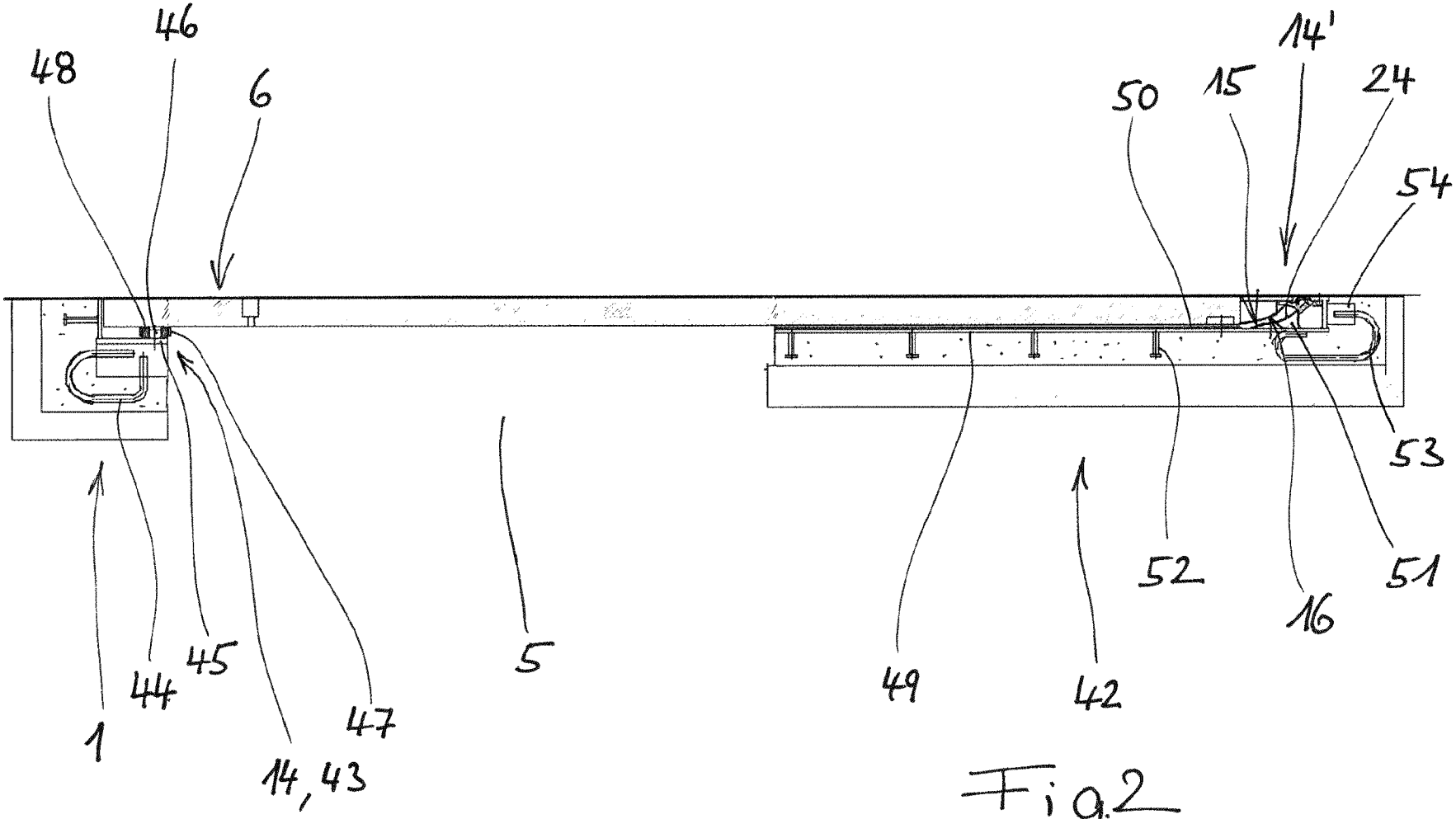
FIG. 2 shows, in a general view, a vertical section through a second inventive building structure.
Figure 2A:
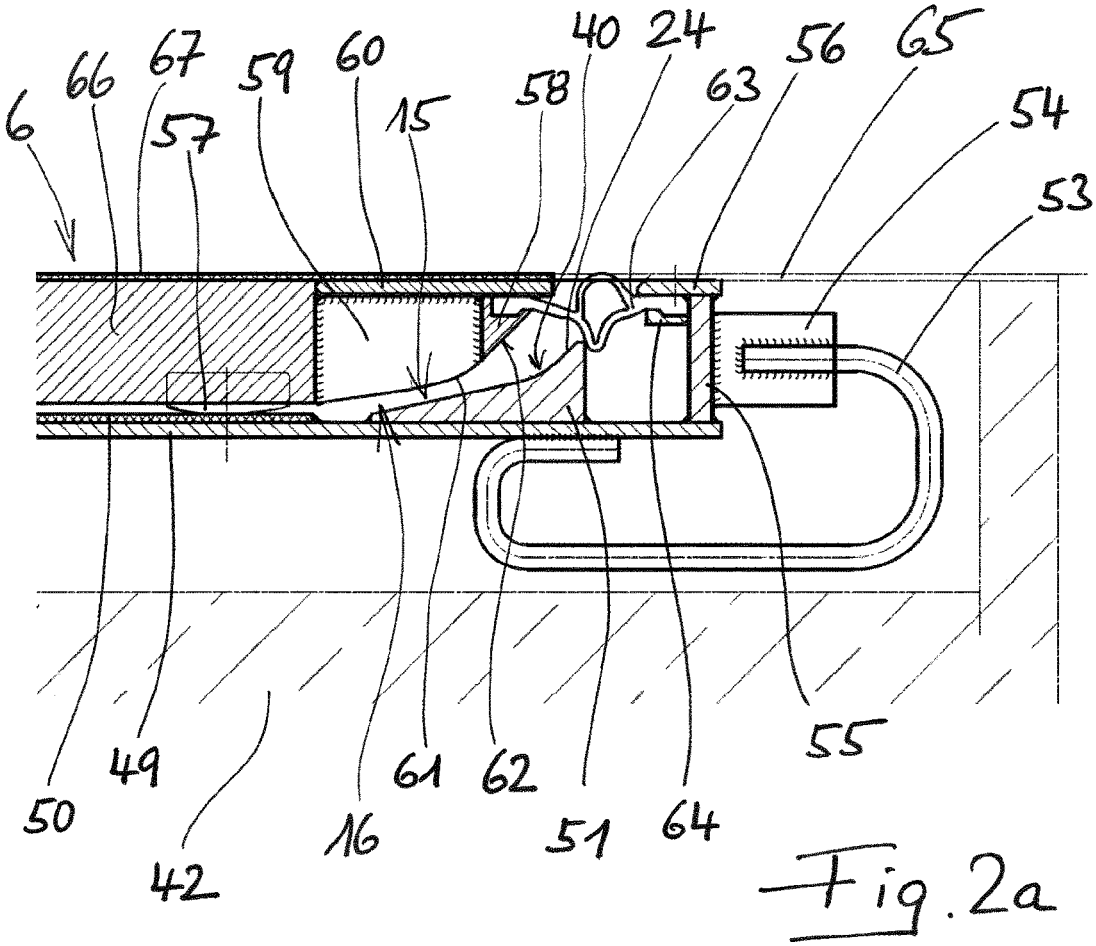
FIG. 2*a* shows a detail of the building structure according to FIG. 2, and FIG. 3 to FIG. 8 show the detail according to FIG. 2*a* during advancing reduction of the clear width of the expansion joint under the effect of a seismic event.
Figure 3:
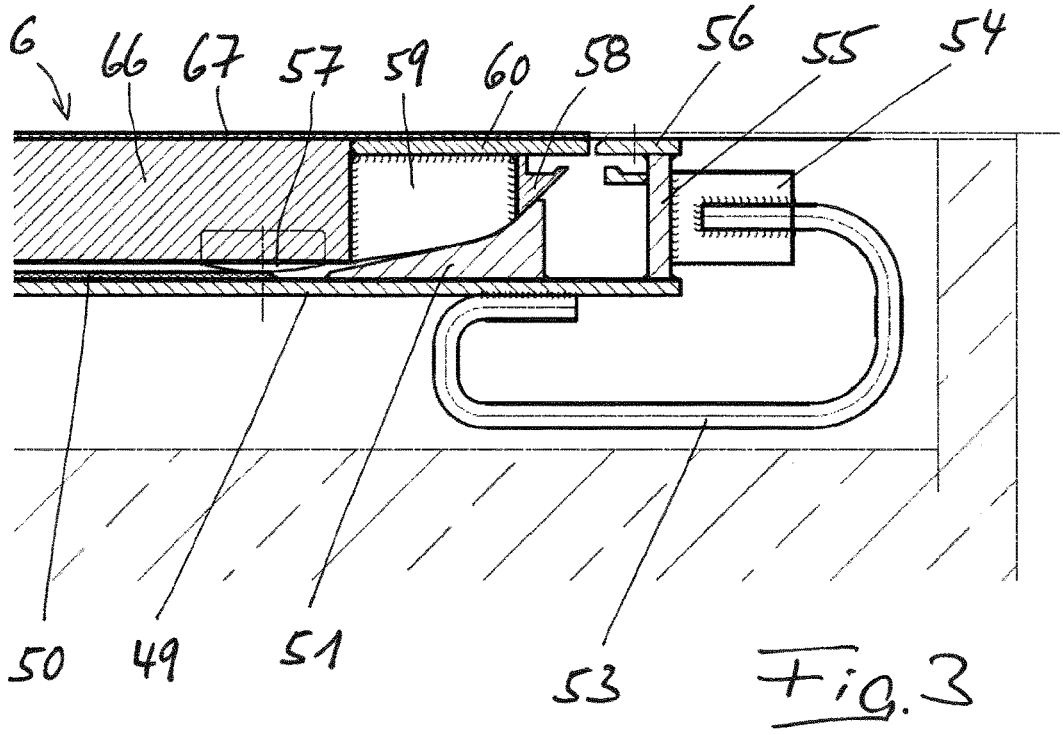
Figure 4:
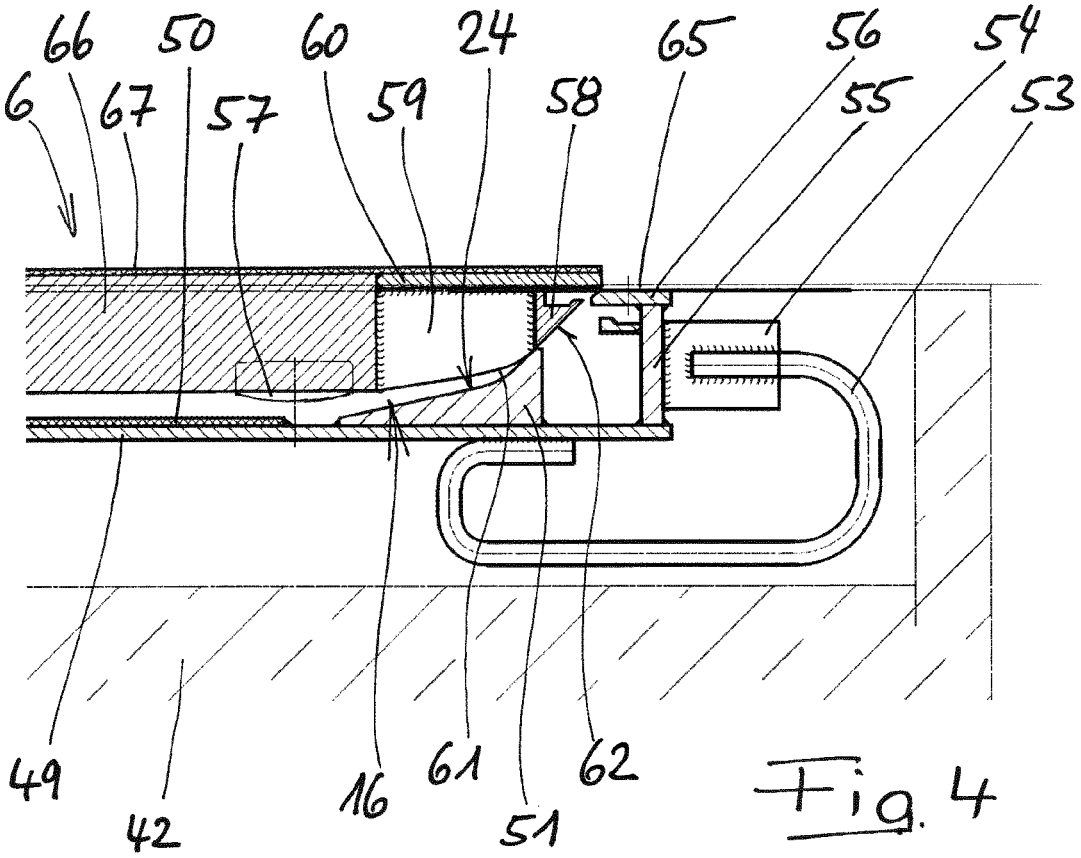

The building structure illustrated in FIGS. 1 and 1*a* comprises two building units 1, of which respectively the base 2, a compensating structure 3 and a walkable covering 4 are shown. (A corresponding description would apply to an analogous implementation of this exemplary embodiment of the invention for an expansion joint that is present between a basic structural unit and a building unit and is bridged by means of a joint cover.) The first and the second building units 1 are bearing-mounted to be laterally movable relative to one another. Between them, specifically between the two bases 2, there is an expansion joint 5. This is bridged with a walkable joint cover 6, which comprises a support plate 7, rim profiles 8, a compensating structure 9 and a walkable covering 10. This support plate 7 is embedded at its rims in corresponding receptacles 11 of rim profiles 8, such that it rests on rim-profile legs 12. Covering 10 is embraced laterally by rim-profile wall portions 13.

Joint cover 6 is braced respectively via a bracing structure 14 on the first and the second building unit 1. Each of these bracing structures 14 comprises a pairing of two sliding partners, namely one bracing sliding partner 15 associated in positionally fixed relationship with the building unit 1 in question and one braced sliding partner 16 associated in positionally fixed relationship with the joint cover.

This bracing sliding partner 15 comprises a sliding plate 17 bearing-mounted on base 2 of the building unit 1 in question as well as—likewise mounted on base 2 of the building unit 1 in question—a ramp profile 18. The respective fastening screws 19 are also shown. Surface 20 of this sliding plate 17 forms a horizontal sliding face 21; and surface 22 of ramp profile 18 forms—merging into one another without stepped discontinuity and without kink—a horizontal sliding face 23 and a sliding ramp 24. The horizontal sliding faces 21 and 23 on the sliding plate and those constructed on the sliding profile lie at the same level. Together they define a "displacement region", in the sense that, during sliding contact of braced sliding partner 16 on horizontal sliding face 21 or 23, a laterally directed movement of the two sliding partners 15 and 16 relative to one another in response to a change of the clear width of the joint gap of expansion joint 5 has no effect on the position of joint cover 6 in the region of the bracing structure 14 in question in vertical direction. A strip 26 consisting of a sliding material—countersunk in a corresponding groove 25—is inserted into horizontal sliding face 23 of ramp profile 18. This sliding-material strip 26 has a different surface texture, specifically a lower hardness and a smaller ratio of static friction and sliding friction than sliding ramp 24 and also than sliding plate 17.

Braced sliding partner 16 is formed by a bulge (or "cam") 27, which is constructed on the bottom of rim profile 8 of joint cover 6 and the surface of which is constructed in the form of a portion of a circular cylinder. In the design configuration—shown in FIGS. 1 and 1*a*—(at average temperature and absence of seismic influences), bulge 27 of rim profile 8 is located approximately centrally on sliding-material strip 26. The width of this sliding-material strip 26 is matched in such a way to the thermal expansion/contraction of building units 1 (and also of joint cover 6) that, within the normal spectrum of operating temperature, rim profile 8 is always positioned with bulge 27 upright on sliding-material strip 26; thus a "service path" for normal thermal compensating movements is present on the sliding-material strip. Seal 28, which is clamped between rim profile 8 and ramp profile 18, and which in any case does not project upward beyond covering 4 of building unit 1 and covering 10 of joint cover 6 in the design configuration illustrated in FIG. 1, has such flexibility that it does not hinder the relative movement of building unit 1 and joint cover 6 relative to one another in the scope of the service path.

A "lifting" region is defined by sliding ramp 24 of ramp profile 18 in the sense that, during approach (caused by seismic influences) of the two building units 1 relative to one another and accordingly a reduction of the clear width of expansion joint 5 of the braced sliding partner 16, i.e. bulge 27 of rim profile 8 slides on sliding ramp 24 after leaving sliding-material strip 26, wherein joint cover 6 is lifted in the region of the bracing structure 14 in question as soon as bulge 27 of rim profile 8 makes contact with sliding ramp 24 during continued movement. In actual fact, in the building structure according to FIGS. 1 and 1*a*, such lifting of joint cover 6 takes place synchronously in the region of both bracing structures 14. This is so because a centering device 29 (operating according to the principle known as such; see WO 01/98599 A1 and U.S. Pat. No. 10,053,857 B1) acts on joint cover 6. This comprises several centering struts 30, which are oriented at an inclination to the joint direction and which are respectively linked at the ends on both sides via swivel heads 31 (ball hinges) to slides 32, which are guided displaceably on linear guides 33 extending parallel to the joint direction. These linear guides 33 are respectively attached to a protrusion of the sliding plate 17 in question extending beyond the base 2 in question. Via a vertical centering bolt 34, the middle of joint cover 6 and the middle of the respective centering strut 30 are aligned perfectly one above the other and, in fact, always at their center and always and independently of the instantaneous clear width of the joint gap of compensating joint 5. Centering device 29 comprises a hold-down means 35 acting on joint cover 6, in that a compression-loaded, prestressed hold-down spring 37 acts between the underside of centering strut 30 and the lower free end 16 of centering bolt 14. To prevent vibrations in the system and canting of centering strut 30, two upright bracing bolts 38 (adjustable with respect to height) having elastic support heads 39 are also attached to the latter. These are mutually positioned in such a manner offset relative to the line connecting the two swivel heads 31 with one another that the two support heads 39 and the two swivel heads 31 together form a rectangle (having point symmetry relative to the axis of centering bolt 34).

Because horizontal sliding face 23 (with sliding-material strip 26 embedded at the same level) and sliding ramp 24 merge directly into one another, continuous bracing of joint cover 6 takes place on the respective bracing structure 14, at first in the displacement region and then in the lifting region, in the course of approach of the two building units 1 toward one another in the sense of a reduction of the clear width of expansion joint 5. Sliding ramp 24 is curved concavely on one portion and convexly on another portion. And, in fact, over a portion ("progression curvature portion" 40) adjacent to sliding-material strip 26, it is constructed in such a way with a steadily increasing slope that, during sliding contact of bulge 27 of rim profile 8 with sliding ramp 24, approach of building units 1 relative to one another (and consequently a reduction of the clear width of the joint gap of expansion joint 5) with acquired constant horizontal velocity leads to lifting of joint cover 6 in the region of the bracing structure 14 in question with steadily increasing vertical velocity. Progression curvature portion 40 is constructed here with—according to the geometry of a clothoid—steadily changing curvature. Adjoining progression curvature portion 40 there is a "degression curvature portion" 41, on which sliding ramp 24 is constructed in such a way with a steadily decreasing slope that, during sliding contact of bulge 27 of rim profile 8 with sliding ramp 24 on its (convex) portion, approach of building units 1 relative to one another (and consequently a reduction of the clear width of the joint gap of expansion joint 5) with acquired constant horizontal velocity leads to lifting of joint cover 6 in the region of the bracing structure 14 in question with steadily decreasing vertical velocity.

Although not illustrated in FIGS. 1 and 1*a*, sliding plate 17 and ramp profile 18 preferably engage in one another, in the region where they meet, preferably via finger-like or corrugated structures that are disposed at the rims and mesh with one another in comb-like manner. In this way the possibility is obtained of adapting, to the supporting substructure, the dimensions of the region that contains horizontal sliding faces 20 and 23 assembled together, wherein—due to the comb-like meshing of the finger-like or corrugated structures—interruption-free sliding of the sliding partner, i.e. of bulge 27, over the assembled horizontal sliding face is assured.

Regarding the building structure illustrated in FIGS. 2 to 8, diverse technical viewpoints are obvious from the foregoing detailed explanations of the exemplary embodiment shown in FIGS. 1 and 1*a*. In this respect, reference is made to the said explanations, unless something to the contrary is indicated by the following descriptions.

The building structure according to FIGS. 2 to 8 comprises a basic structural unit 42 and a building unit 1 bearing-mounted to be movable laterally relative thereto. Laterally of building unit 1, an expansion joint 5—bridged by a walkable joint cover 6—is present between it and basic structural unit 42. Joint cover 6 is braced via a first bracing structure 14 on building unit 1 and via a second bracing structure 14' on basic structural unit 42. This first bracing structure 14 is realized in the form of a "fixed bearing" 43, i.e. a bearing that does not permit any noteworthy horizontal displaceability. For this purpose, retaining bolts 46 extend upward from an anchor plate 45—which is fixed via anchoring straps 44 on building unit 1. These are enclosed by retaining rings 47, which extend downward from joint cover 6. The annular space between retaining bolts 46 and associated retaining ring 47 is then filled respectively by a polymer bearing ring 48 (e.g. made of PA6), which—having low flexibility with respect to horizontal displacements of joint cover 6 and tilting of joint cover 6 due to lifting at the opposite end (see below)—primarily functions to divert the vertical load from joint cover 6 into anchor plate 45.

Second bracing structure 14' comprises a pairing of two sliding partners, namely one bracing sliding partner 15 associated in positionally fixed relationship with basic structural unit 42 and one braced sliding partner 16 associated in positionally fixed relationship with joint cover 6. Bracing sliding partner 15 comprises a bracing plate 49, which is flat on the top side and which is anchored on basic structural unit 42, laid-out sliding covering 50 and an approximately wedge-shaped ramp attachment 51, fixed on bracing plate 49 and forming a sliding ramp 24. The fixation of this bracing plate 49 on basic structural unit 42 is achieved via anchoring bolts 52 extending downward from it as well as via anchoring straps 53, which are welded onto bracing plate 49 and—via swing boards 54—onto an anchor plate 55 protruding from this. A head plate 56, which—as a further bracing element—is in this respect likewise part of bracing sliding partner 15 provided with sliding ramp 24, is placed on top of anchor plate 55, and slides thereon as joint cover 6—after corresponding transfer of the bracing—during certain operating conditions under seismic effect (see below).

Braced sliding partner 16 comprises bracing humps 57, which are disposed on the underside of joint cover 6 and constructed, for example, as sliding cams made of polymer material or light metal, and which are designed for cooperating (sliding contact) with sliding covering 50 of bracing sliding partner 15, a chamfered profile rail 58 disposed in the rim region of joint cover 6 and stiffening plates 59, which brace covering support plate 60 of joint cover 6 and are profiled on their lower edge 61 in such a way that they merge free of discontinuities and edges into the obliquely neighboring sliding surface 62 of profile rail 58.

A flexible seal 63—constructed as an asymmetric hump-shaped seal—closes the gap between joint cover 6 and head plate 56. For this purpose, its two rims are clamped sealingly on one side between covering support plate 60 and profile rail 58 of joint cover 6 and on the other side between head plate 56 and a cleat 64 welded onto anchor plate 55.

A service path, within which normal temperature-induced expansions and contractions of building unit 1 (and of joint cover 6) are compensated, also exists in this building structure, as in that according to FIGS. 1 and 1*a*. Within this service region, exclusively bracing of joint cover 6 on sliding covering 50 takes place in the region of second bracing structure 14' via bracing humps 57. The same is true in the case of a seismic event having an effect of enlarging the clear width of the joint gap of expansion joint 5. In contrast, as illustrated in FIGS. 3 to 8, the braced sliding partner 16, namely profile rail 58 and stiffening plate 59, slides on sliding ramp 24 during a movement, caused by a seismic event, of building unit 1 and basic structural unit 42 relative to one another with an effect of reducing the clear width of expansion joint 5. Thus a (sudden) transfer of the bracing of joint cover 6 on the bracing structure 14' in question takes place from the displacement region to the lifting region in the course of an approach of building unit 1 toward basic structural unit 42 in the sense of a reduction of the clear width of expansion joint 5. The sliding contact of braced sliding partner 16 on sliding ramp 24 that continues during the further reduction of the clear width of expansion joint 5 leads to lifting of joint cover 6 in the region of second bracing structure 14'. Sliding ramp 24 is curved in one region, so that there—in progression curvature portion 40—it is constructed in such a way with a steadily increasing slope that, during sliding contact of braced sliding partner 16 on this portion of sliding ramp 24 (for example during the movement being completed between the situation according to FIG. 3 and the situation according to FIG. 4), an approach of building unit 1 toward basic structural unit 42 with acquired constant horizontal velocity leads to lifting of joint cover 6 in the region of the bracing structure 14' in question with steadily increasing vertical velocity.

Figure 5:
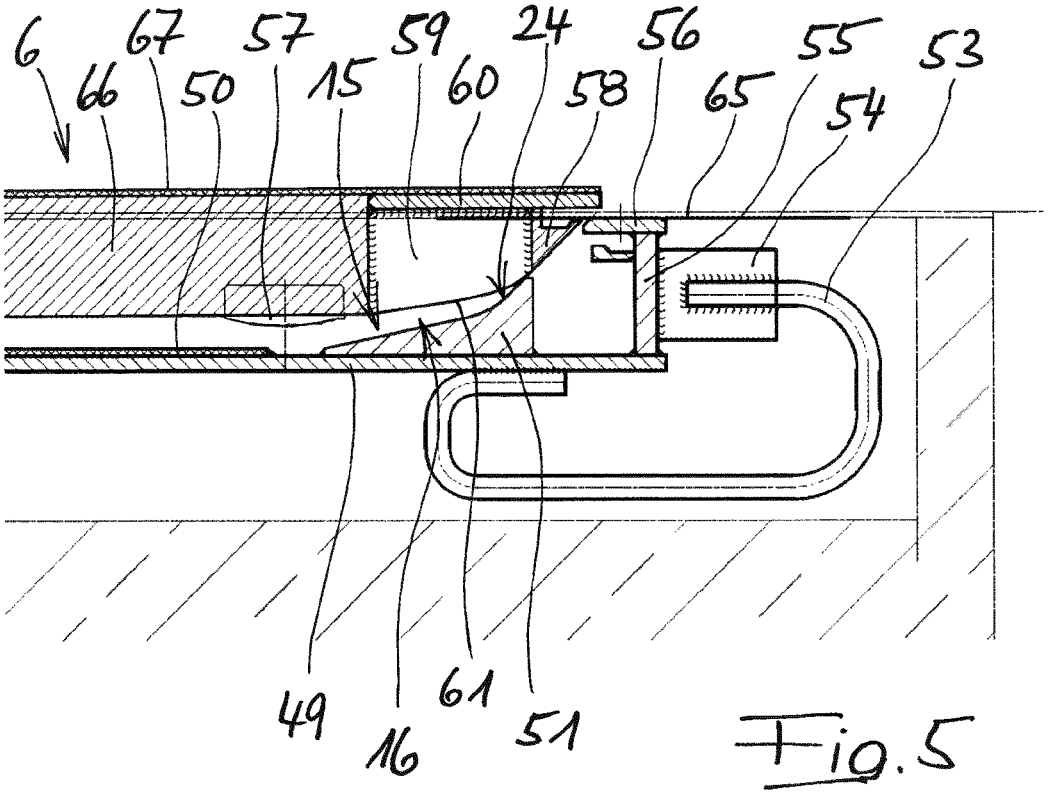
Figure 6:
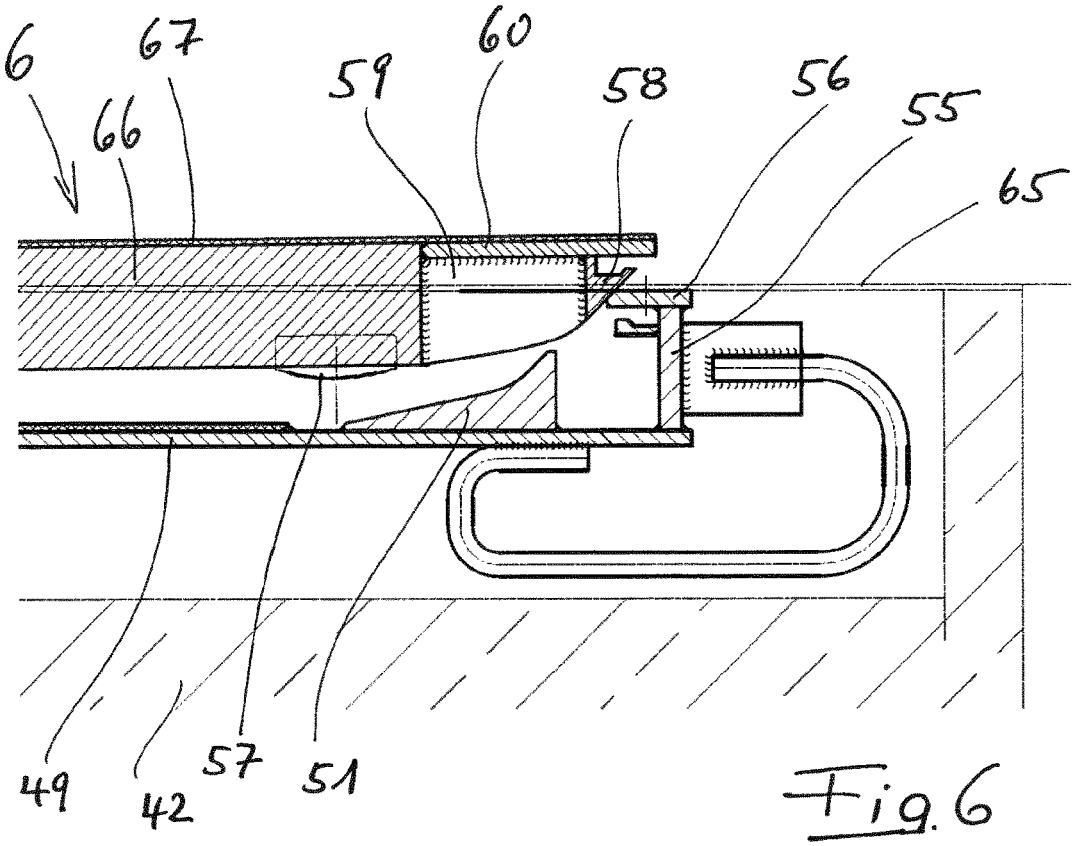
Figure 7:
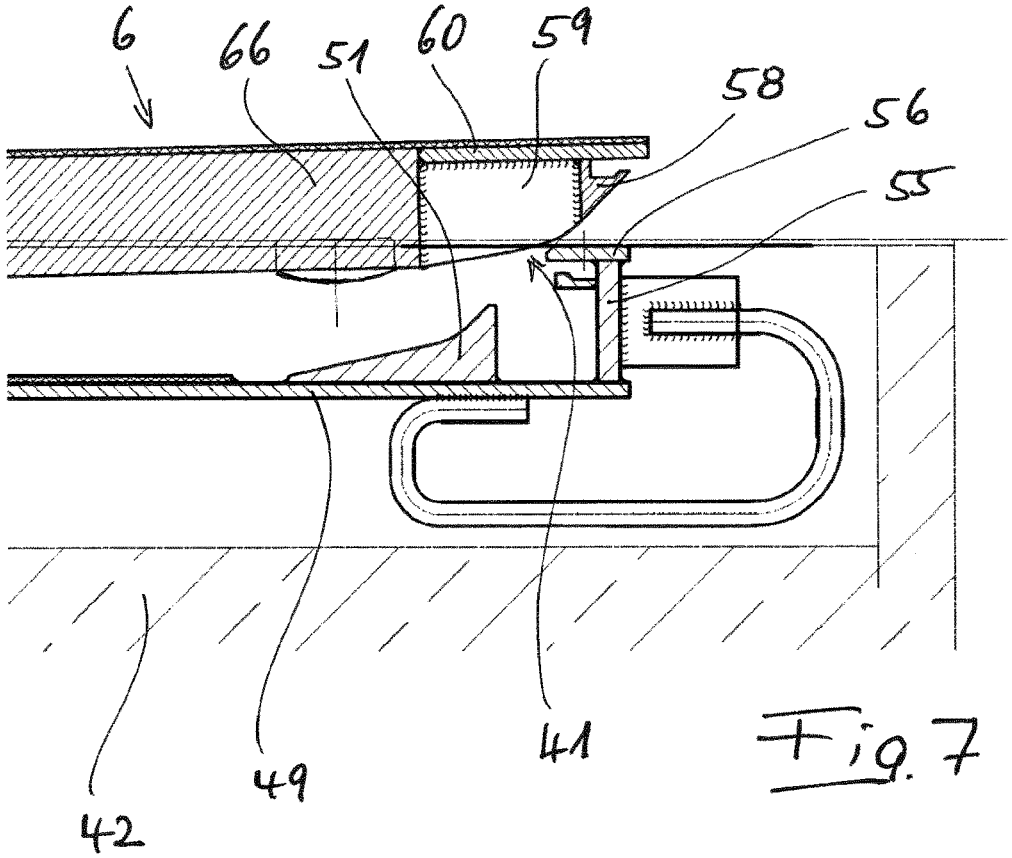
Figure 8:
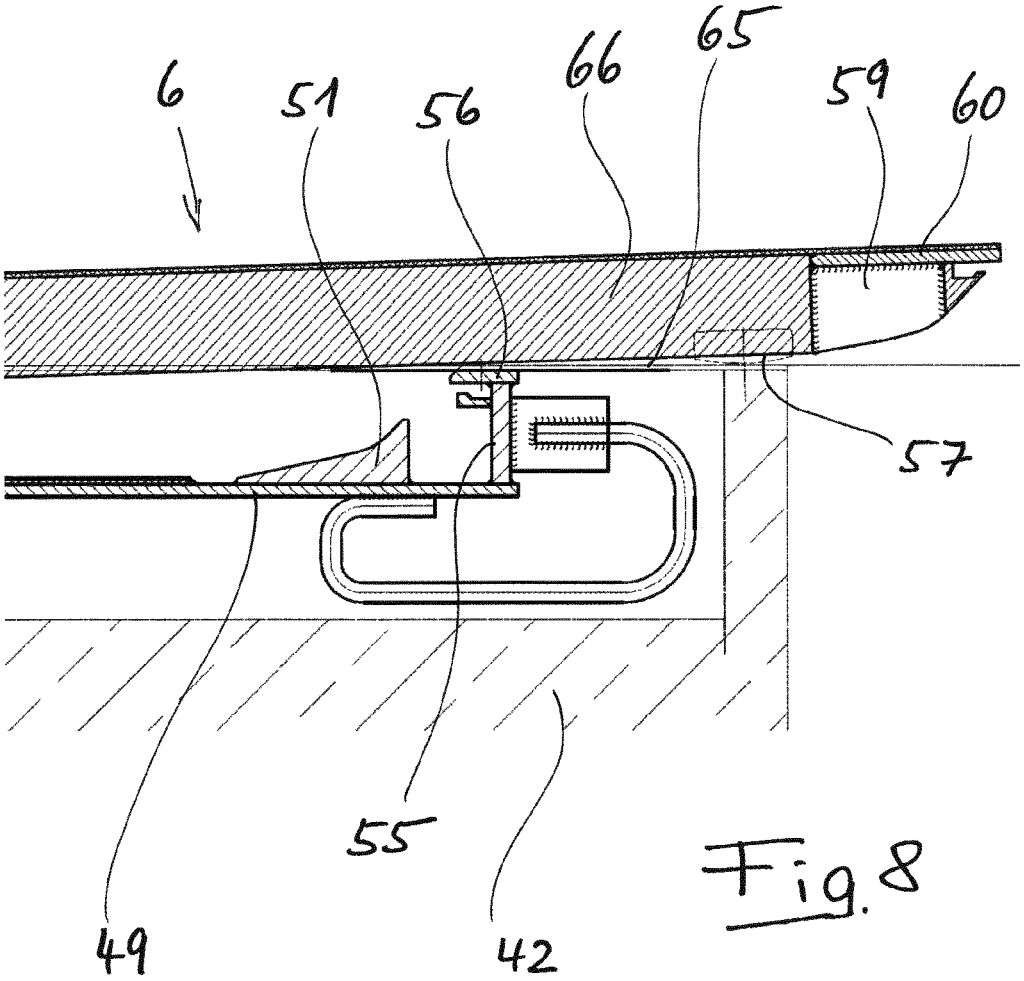

In a configuration such as illustrated in FIG. 5, the bracing of joint cover 6 changes to the effect that it is "passed on" to head plate 56 (or subsequently to covering 65 applied there). During continued movement, joint cover 6 rests slidingly on head plate 56 (which is chamfered at the rims) or on covering 65 applied there, at first (see FIG. 6) with profile rail 58, then (see FIG. 7) with stiffening plates 59 and finally (see FIG. 8) with the underside of joint cover 6. The geometry—cooperating temporarily with sliding ramp 24—of the braced sliding partner, i.e. the sequence of profile rail 58 and stiffening plates 59, forms a certain wedge-like shape. Due to the convex curvature of lower rim 61 of stiffening plate 59 with the consequence of a slope that increases steadily (in the direction of the displacement of the contact point toward the bracing sliding partner that takes place during lifting of joint cover 6), a "degression curvature portion 41" is then obtained in the sense that, during sliding contact of stiffening plate 59 on (chamfered) head plate 56 (or on covering 65 applied there), an approach of building unit 1 and basic structural unit 42 relative to one another (and consequently a reduction of the clear width of expansion joint 5) with acquired constant horizontal velocity leads to lifting of joint cover 6 in the region of the bracing structure 14' in question with steadily decreasing vertical velocity.

Finally, it can be inferred from the drawing that joint cover 6 is provided over its length with a supporting structural component 66 and a covering 67.

By way of precaution—to avoid misconceptions—it is to be pointed out that neither the conceptional difference (lifting of the joint cover on one side or on both sides) between the two illustrated exemplary embodiments nor the constructive details implemented therein are related to the fact that the joint cover in one case bridges an expansion joint present between a building unit and a basic structural unit and in the other case an expansion joint between two building units. In this respect, the viewpoints are interchangeable without further thought, as a person skilled in the art easily recognizes. The situation is analogous for joint covers that are liftable on only one side and that bridge an expansion joint present between a building unit and a basic structural unit, the liftable side can be assigned to the building unit or else to the basic structural unit.

What is claimed is:

1. A building structure comprising:

a walkable or drivable joint cover covering an expansion joint, the expansion joint having a clear width; and a bracing structure allowing for lateral relative movement, the bracing structure comprising a braced sliding partner associated in a positionally fixed relationship with the joint cover and a bracing sliding partner, wherein the joint cover is braced by the bracing structure, and within the bracing structure, the braced sliding partner is braced on the bracing sliding partner, wherein the bracing sliding partner has a lifting region constructed as a sliding ramp such that during sliding contact of the braced sliding partner with the sliding ramp of the bracing sliding partner generated by a reduction of the clear width, such sliding contact leads to lifting of the joint cover adjacent the bracing structure, wherein the sliding ramp comprises a degression curvature portion with a steadily decreasing slope such that, upon sliding contact of the braced sliding partner with the degression curvature portion of the sliding ramp generated by the reduction of the clear width, a ratio of a vertical velocity of lifting of the joint cover adjacent the bracing structure to a horizontal velocity of the reduction of the clear width decreases steadily.

2. The building structure of claim 1, wherein the degression curvature portion of the sliding ramp has a sliding face curved with steadily changing curvature.

3. The building structure of claim 2, wherein the curvature of the curved sliding face at the degression curvature portion of the sliding ramp curves according to a parabola portion or a clothoid portion.

4. The building structure of claim 1, wherein the braced sliding partner sliding on the degression curvature portion of the sliding ramp has a convexly curved geometry.

5. The building structure of claim 4, wherein a sum of a smallest radii of curvature of the degression curvature portion of the sliding ramp and the braced sliding partner cooperating slidingly therewith is at least 25 mm.

6. The building structure of claim 5, wherein the sum of the smallest radii of curvature of the degression curvature portion of the sliding ramp and the braced sliding partner cooperating slidingly therewith is at least 40 mm.

7. The building structure of claim 4, wherein a sum of a smallest radii of curvature of the degression curvature portion of the sliding ramp and the braced sliding partner cooperating slidingly therewith is at most 90 mm.

8. The building structure of claim 7, wherein the sum of the smallest radii of curvature of the degression curvature portion of the sliding ramp and the braced sliding partner cooperating slidingly therewith is at most 70 mm.

9. The building structure of claim 1, wherein the bracing sliding partner further comprises a displacement region having a horizontal sliding face that, during sliding contact of the braced sliding partner with the horizontal sliding face, a laterally directed movement of the braced sliding partner relative to the bracing sliding partner has no effect on a vertical position of the joint cover adjacent the bracing structure.

10. The building structure of claim 9, wherein the sliding ramp and the horizontal sliding face merge directly into one another, wherein, during the reduction of the clear width, continuous bracing of the joint cover on a corresponding bracing structure is maintained at either the displacement region or the lifting region.

11. The building structure of claim 10, wherein the sliding ramp merges into the horizontal sliding face without any discontinuity with respect to the slope.

12. The building structure of claim 1, wherein the sliding ramp has a progression curvature portion with a steadily increasing slope such that, upon sliding contact of the braced sliding partner with the progression curvature portion of the sliding ramp during the reduction of the clear width, the ratio of the vertical velocity of lifting of the joint cover adjacent the bracing structure to the horizontal velocity of the reduction of the clear width increases steadily.

13. The building structure of claim 12, wherein the progression curvature portion of the sliding ramp has a sliding face curved with steadily increasing curvature.

14. The building structure of claim 13, wherein the curvature of the curved sliding face adjacent the progression curvature portion of the sliding ramp curves according to a clothoid portion.

15. The building structure of claim 1 comprising two bracing structures and a centering device acting on the joint cover.

16. The building structure of claim 15, wherein the centering device comprises a hold-down means acting on the joint cover.

* * * * *